US005267442A

United States Patent [19]

Clark

[11] Patent Number: 5,267,442

[45] Date of Patent: Dec. 7, 1993

[54] FUEL NOZZLE WITH ECCENTRIC PRIMARY CIRCUIT ORIFICE

[75] Inventor: Jim A. Clark, Jupiter, Fla.

[73] Assignee: United Technologies Corporation, Hartford, Conn.

[21] Appl. No.: 977,476

[22] Filed: Nov. 17, 1992

[51] Int. Cl.[5] ..... F23R 3/14

[52] U.S. Cl. ..... 60/748; 60/39.142

[58] Field of Search ..... 60/748, 743, 742, 39.094, 60/39.142, 740; 239/405, 406

[56] References Cited

U.S. PATENT DOCUMENTS 2,881,827 4/1959 Roche et al. ..... 60/39.094

4,970,865 11/1990 Shekelton et al. ..... 60/742

*Primary Examiner*—Richard A. Bertsch

*Assistant Examiner*—Timothy S. Thorpe

*Attorney, Agent, or Firm*—Norman Friedland

[57] ABSTRACT

The orifice of the primary circuit on a dual circuit fuel nozzle for a combustor of a gas turbine engine is eccentrically located at the nozzle tip to inject fuel directly toward the prefilming surface of the air swirler and located in proximity to the igniter to enhance ignition. In another embodiment the fuel nozzles circumferentially spaced around the dome of the combustor include the eccentric orifice of the primary circuit to enhance lean blowout characteristics.

4 Claims, 3 Drawing Sheets

FUEL NOZZLE WITH ECCENTRIC PRIMARY CIRCUIT ORIFICE

CROSS REFERENCE

This invention relates to the matter disclosed in my patent application Ser. No. 07/977,473, filed on Nov. 17, 1992 entitled "Fuel Nozzle with Asymmetrical Secondary Spray" bearing Attorney Docket F-6467 and assigned to United Technologies Corporation, the assignee common with this patent application.

TECHNICAL FIELD

This invention relates to fuel nozzles for combustors for gas turbine engines and particularly to the orifice location of the primary circuit of a dual circuit fuel nozzle.

BACKGROUND ART

With the advent of higher performance gas turbine engines and advanced combustors, it has become necessary to increase the size of the combustor and air swirlers to accommodate the increase in swirler air to control smoke emissions. This has increased the complexity and problems associated with ignition. Of particular note is the fact that since the distance between the fuel nozzle orifice and the inner wall of the swirler is moving further apart, the problem becomes even more difficult and complex. Hence, where, in heretofore fuel nozzles, the distance between the primary circuit orifice in a two circuit fuel nozzle inherently lent itself to good ignition performance, the larger combustors inherently dictate against good ignition performance.

This invention addresses the ignition problem associated with advanced combustor that utilize a primary and secondary circuit of the type disclosed in U.S. Pat. No. 4,417,439 granted to D. Sepulveda et al on Nov. 29, 1983 entitled "Starting Means for a Gas Turbine Engine" and U.S. Pat. No. 4,785,623 granted to H. G. Reynolds on Nov. 22, 1988 entitled "Combustor Seal and Support", both of which are commonly assigned to United Technologies Corporation, the assignee of this patent application and both incorporated by reference herein. In the 4,417,439 patent, supra, the ignition was improved upon by incorporating restrictors in the fuel lines connecting each of the fuel nozzles except the ones located adjacent the igniter. In that instance, the fuel flow in each of the restricted nozzles was reduced leaving additional fuel of the total for the unrestricted fuel nozzle. Again, because the swirler distance to the primary nozzle was close enough this presented an entirely different problem from the one confronting applicant.

DISCLOSURE OF INVENTION

An object of this invention is to provide improved fuel nozzles for attaining improved ignition of the combustor of gas turbine engines.

A feature of this invention is to include in the primary circuit of the fuel nozzle a discharge orifice in the nozzle tip that is eccentrically oriented.

A feature of this invention is to locate the eccentric primary fuel circuit orifice to direct fuel to the inner wall of relatively large high shear swirlers and in proximity to the igniter of the combustor.

A still further feature is to provide a judiciously located eccentric primary fuel circuit orifice to improve lean blowout characteristics of the combustor.

A still further feature of this invention is to provide improved fuel nozzles for improving ignition and lean blowout characteristics which nozzle is characterized as simple to manufacture and relatively inexpensive to fabricate, without adversely affecting the envelope size of the combustor and requiring large modifications to existing fuel nozzle designs.

The foregoing and other features of the present invention will become more apparent from the following description and accompanying drawings.

BEST MODE FOR CARRYING OUT THE INVENTION

While in its preferred embodiment this invention is utilized on an annular burner for gas turbine engines for powering aircraft, as will be apparent to those skilled in this art the invention has utility in other types of combustors and can be utilized in engines designed for other applications, including without limitation, marine and industrial applications. It is particularly applicable in annular combustors that have relatively large high shear air swirlers.

Figure 1:
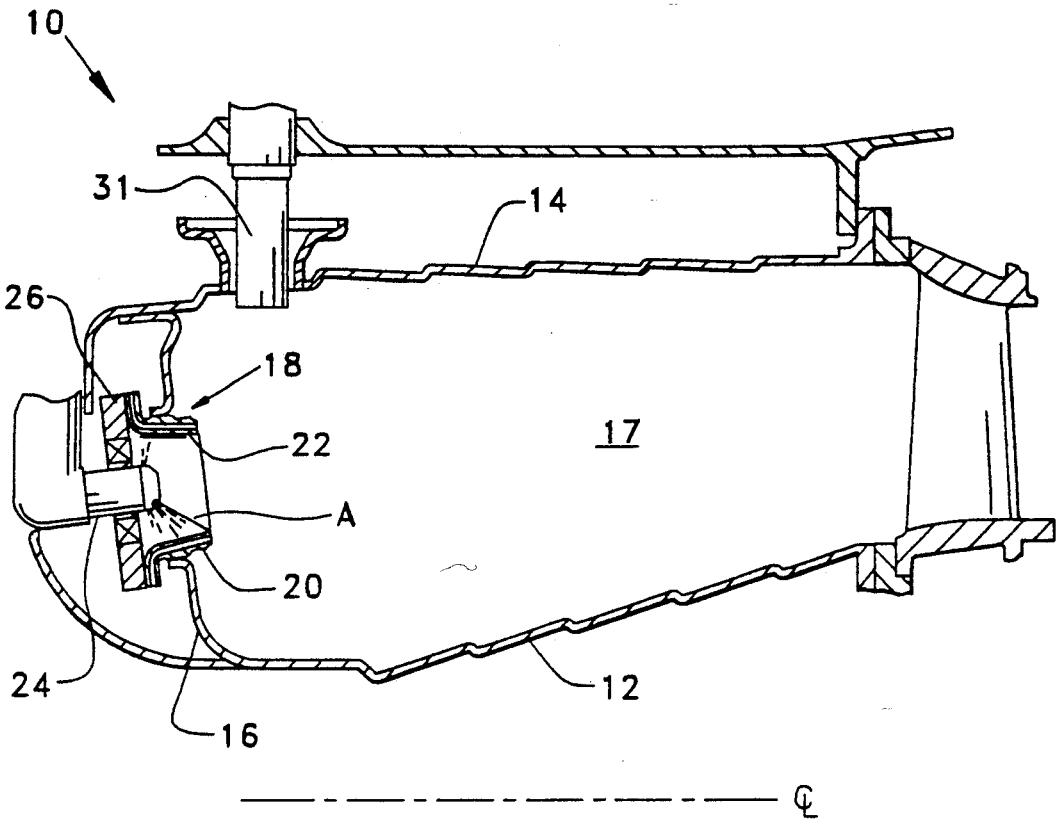
FIG. 1 is a view partly in elevation, partly in section and partly in schematic illustrating this invention.

Referring now to FIG. 1 which schematically illustrates a typical annular burner generally indicated by reference numeral 10 as having an inner annular liner 12 and a concentrically disposed outer annular liner 14 that is coaxially mounted around the engine's center line. The forward ends of the inner and outer liners are connected to and enclosed by dome 16, and together therewith form an annular open ended combustion chamber 18 for feeding hot gases to the engine's turbine (not shown). Combustors of this type are utilized on the F-100, JT9D, PW4000 families of engines that are manufactured by Pratt & Whitney, a division of United Technologies Corporation, the assignee of this patent application.

For the sake of convenience and simplicity this description will only concern itself with the fuel nozzle and associated air swirler, which serve to introduce the fuel into the combustor. As can be seen in this FIG. 1, a plurality of suitable and well known air swirlers 18 (only one being shown) having an outer conically shaped wall 20 and a concentrically disposed conically shaped inner wall 22 are mounted in circumferentially spaced holes formed in dome 16. Fuel nozzle 24, including air swirler 26 are centrally disposed on the foreward end of air swirler 18. The swirling air mixes with fuel injected from the fuel nozzle in the front end of the combustion chamber, ignited by the igniter 30, for firing the combustor. The combusted gases flow rearward toward the open end of the combustor and into the turbine section (not shown).

Figure 2:
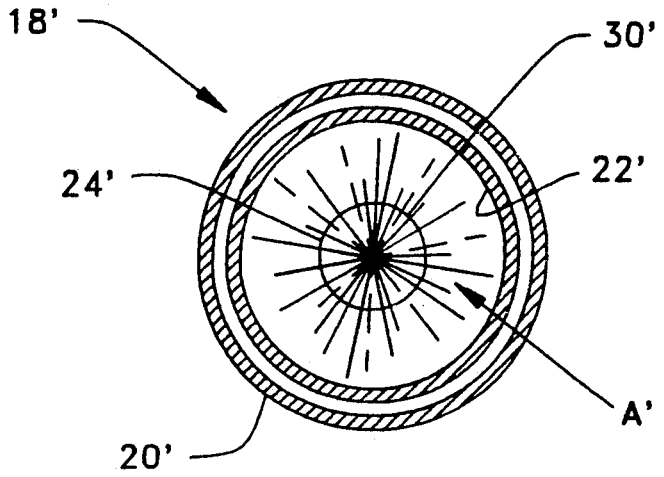
Fig. 2 Prior Art
FIG. 2 is an end view in schematic of a Prior Art fuel nozzle.
Figure 2A:
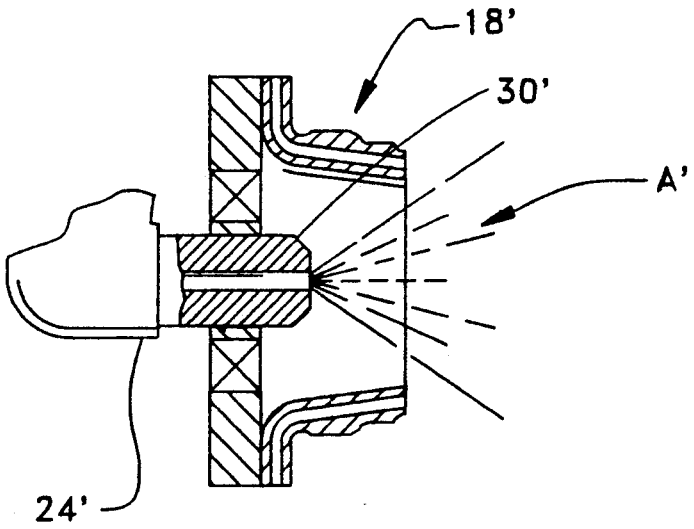
Fig. 2a Prior Art
FIG. 2A is a partial side view schematically illustrating the Prior Art fuel nozzle depicted in FIG. 1.

To better understand this invention reference is made to FIG. 2 and FIG. 2A which schematically show the front end and side view a Prior Art fuel nozzle 24, and air swirler 18'. (The prime symbols refer to identical reference numerals without the prime symbols of like elements). As can be seen in FIGS. 2 and 2A, the fuel spray indicated by reference letter A discharges through a central orifice in fuel nozzle 22' and forms a conically shaped spray. The orifice is concentrically disposed with the axis of the nozzle tip and air swirler 18'. The fuel emitted in a holiow spray A moves radially outward toward the swirler inner wall 22'. As the fuel spray A moves further outward, its trajectory is altered by the axial component of the swirling air admitted internally of swirler 18'. Obviously, in swirlers where the inner surface of the inner wall 22' is close enough to the tip 30, the axial component of the swirling air doesn't preclude spray A from reaching the prefilming surface provided by the inner wall 22'.

It is apparent from the foregoing that in heretofore known fuel nozzles for combustors of gas turbine engines, the fuel/air mixture within the swirlers inherently had no critical igniter problems. However, this is not the case in larger diameter swirlers. Obviously the axial component of the swirling air over distance can bend the spray A and prevent it from reaching the prefilming surface on inner wall 22'.

While some success for alleviating this problem have been attained by widening the spray angle or changing the fuel tip's axial position, such solutions have met with serious constraints because of the manufacturing problems associated therewith. This invention solves this problem by judiciously locating the primary fuel circuit orifice eccentrically to direct the fuel spray directly toward the prefilming surface.

Figure 3:
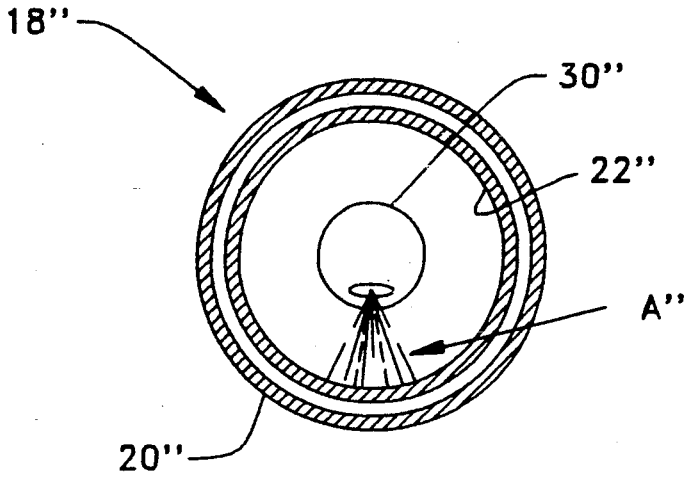
FIG. 3 is an end view schematially illustrating the present invention.
Figure 3A:
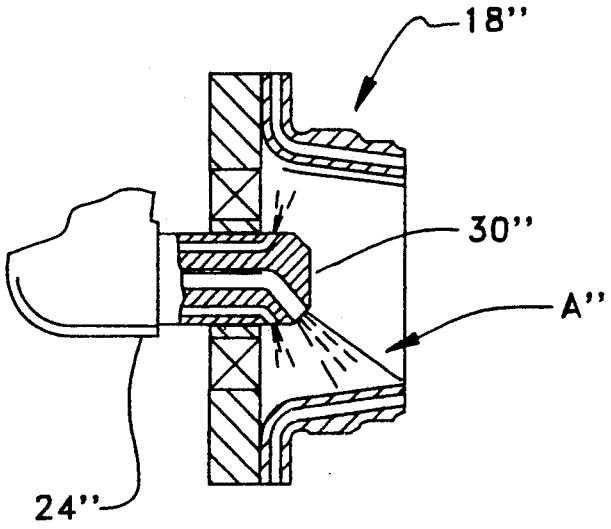
FIG. 3A is a partial side view in schematic of the fuel depicted in FIG. 3.

This solution can best be seen by referring to the schematic illustrations in FIGS. 3 and 3A. Like elements in these FIGS. are referenced with double prime symbols. As is apparent from viewing these FIGS. the orifice of the primary circuit is located off of the axis of tip 30'' of fuel nozzle 24''. This allows the spray A'' to spray more directly on the prefilming surface of inner wall 22''. Preferably the angle of the cone formed by spray A'' emitted from the eccentric orifice is made relatively small, keeping the cone relatively tight. It is apparent from the foregoing that the spray can more readily penetrate the swirling air and reach the prefilming surface.

In the description of the fuel nozzles immediately above, the fuel nozzles are of the type that include a primary circuit and a secondary circuit. The secondary circuit is actuated during the high power operating regimes of the combustor's operating envelope. The primary circuit is initially actuated during combustor ignition and during idle and aircraft taxiing procedures. It is left on until engine shut-down. However, since one of the uses for this invention is for combustor ignition, the secondary fuel circuit has been omitted from this description. Suffice it to say that fuel circuits are adequately described in U.S. Pat. No. 4,417,439, supra, and for more details reference should be made thereto. Also, it should be pointed out that the orifice of the secondary fuel circuit may be annular shaped and concentric with the fuel nozzle tip and air swirler axes or it may be in the form of radial jets. Radial jets are orifices that are circumferentially spaced around the tip of the fuel nozzle.

Figure 4:
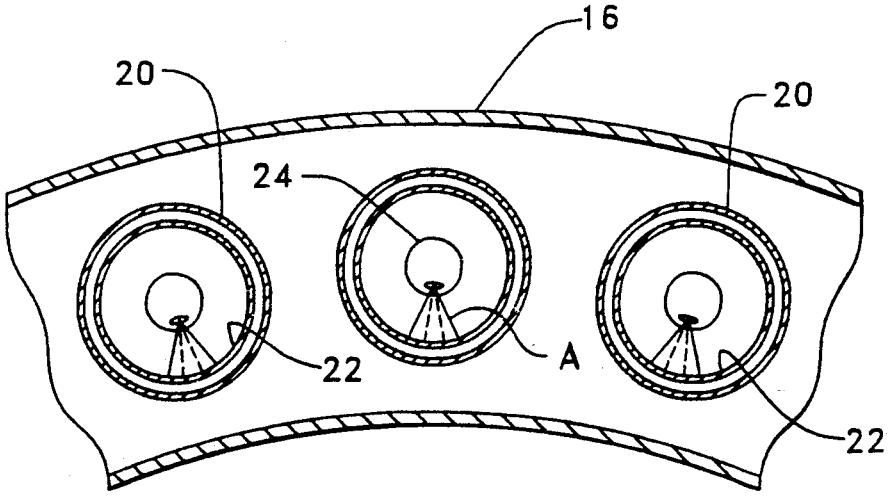
FIG. 4 is a partial schematic view showing the front end of the combustor and the fuel nozzle alignment for lean blowout improvement.

This invention can also be utilized to prevent lean blowout, that is, enhance lean blowout characteristics. FIG. 4, illustrates an embodiment where this invention is employed to enhance lean blowout, i.e., allows the fuel/air ratio to attain lower values before the flame blows out. As can be seen in this FIG. the spray from the eccentric orifices from the primary circuit of adjacent fuel nozzles 24 are all directed toward the prefilming surface of the inner wall 22 of air swirlers 18 in a direction toward the wall of dome 16. This is in the direction of the recirculating zones of the combustor and hence, in the flame holding region. The eccentric orifices tend to keep combustion stabilized at much lower fuel/air ratios and hence serve to prevent undesirable lean flameouts.

Although this invention has been shown and described with respect to detailed embodiments thereof, it will be appreciated and understood by those skilled in the art that various changes in form an detail thereof may be made without departing from the spirit and scope of the claimed invention.

I claim:

1. A fuel nozzle for a gas turbine engine of the type that includes a primary circuit for flowing fuel operable over low and high power gas turbine engine operation and secondary circuit for flowing fuel operable over solely high power gas turbine engine operation, a high shear air swirler for atomizing fuel, the axis of the tip of the fuel nozzle concentrically disposed with the axis of said high shear air swirler, the improvement comprising an orifice at the discharge end of the primary circuit located at the tip of the fuel nozzle and being eccentric relative to said axis, the fuel egressing from said orifice being directed to the inner surface of said high shear air swirler to mix with air for said high shear air swirler so as to be atomized aerodynamically and independent of said fuel nozzle prior to being combusted.

2. A fuel nozzle as claimed in claim 1 wherein the angle of the spray of fuel egressing from said orifice is at a relatively narrow angle and substantially columnar.

3. For a combustor of a gas turbine engine including at least one fuel nozzle operable over a low power and high power regime, liner means defining a combustion chamber having a central axis, an igniter extending through said liner means in said combustion chamber, a dome mounted on said liner means encapsulating the forward end and together therewith defining an open ended combustion chamber, high shear air swirler means having an annular open ended body and an inner surface whose axis is generally parallel to said central axis mounted in an aperture formed in said dome for admitting swirling air into said combustion chamber, said fuel nozzle concentrically mounted in said annular body, said fuel nozzle having a primary fuel circuit for injecting fuel into said combustion chamber during said low power regime and a secondary fuel circuit for injecting fuel in said combustion chamber solely during said high power regime, means for penetrating said swirling air of said high shear air swirler means including a discharge orifice communicating with said primary circuit at the tip of said fuel nozzle, said orifice being eccentrically mounted relative to the central axis of said fuel nozzle for directing fuel from said primary circuit to the inner surface of said high shear air swirler means for atomizing the fuel aerodynamically and independent of said fuel nozzle, and said igniter in said combustion chamber in proximity to said fuel nozzle whereby the fuel and air mixture in said high shear air swirler means enhances ignition of said fuel and air mixture.

4. For a combustor as claimed in claim 3 including a plurality of said fuel nozzles circumferentially mounted in complementary apertures formed in said dome, each of said fuel nozzles having penetrating means with an eccentric orifice communicating with said primary circuit for directing fuel to the inner surface of said high shear air swirler means for atomizing said fuel aerodynamically and independent of said fuel nozzle whereby the lean blowout characteristics of said combustion chamber is enhanced.

* * * * *